US005203508A

United States Patent [19]

Westenberger

[11] Patent Number: 5,203,508

[45] Date of Patent: Apr. 20, 1993

[54] DOSING GUN, IN PARTICULAR HIGH-PRESSURE DOSING GUN

[76] Inventor: Walter Westenberger, Bischof-Ketteler-Strasse 11, D-6052 Mühlheim, Fed. Rep. of Germany

[21] Appl. No.: 572,964

[22] PCT Filed: Mar. 17, 1989

[86] PCT No.: PCT/EP89/00286

§ 371 Date: Sep. 12, 1990

§ 102(e) Date: Sep. 12, 1990

[87] PCT Pub. No.: WO89/08505

PCT Pub. Date: Sep. 21, 1989

[51] Int. Cl.[5] ..... B05B 1/28; B05B 1/30

[52] U.S. Cl. ..... 239/290; 239/533.15; 239/579; 137/509; 251/63.5; 251/340

[58] Field of Search ..... 239/290, 291, 296, 533.1, 239/533.15, 569, 570, 579; 137/509; 251/63.5, 63.6, 340

[56] References Cited

U.S. PATENT DOCUMENTS 3,332,623 7/1967 Gallant ..... 239/290
3,561,680 2/1971 Ott ..... 239/570
4,650,119 3/1987 Pomponi, Jr. ..... 239/296
4,735,362 4/1988 Trautwein et al. ..... 239/533.1
4,982,899 1/1991 Kille et al. ..... 239/569

FOREIGN PATENT DOCUMENTS 1243062 12/1967 Fed. Rep. of Germany .
2204942 3/1974 Fed. Rep. of Germany .
2346467 3/1975 Fed. Rep. of Germany ..... 239/533.15
3202189 11/1983 Fed. Rep. of Germany .
2184151 12/1973 France .

*Primary Examiner*—Andres Kashnikow
*Assistant Examiner*—Christopher G. Trainor
*Attorney, Agent, or Firm*—Cushman, Darby & Cushman

[57] ABSTRACT

A dosing gun (500) comprising a revolving valve element (518), arranged fixedly in a first casing (506) which is immovably connected with the gun housing (502). The first casing (506) has a second spring-loaded casing (544) linked to it in a mobile way, which contains a hollow cylinder (514) having on its frontal part valve seats (542, 554). The dosing gun (500) can operate with or without a supply of compressed air.

31 Claims, 7 Drawing Sheets

DOSING GUN, IN PARTICULAR HIGH-PRESSURE DOSING GUN

Figure 1:
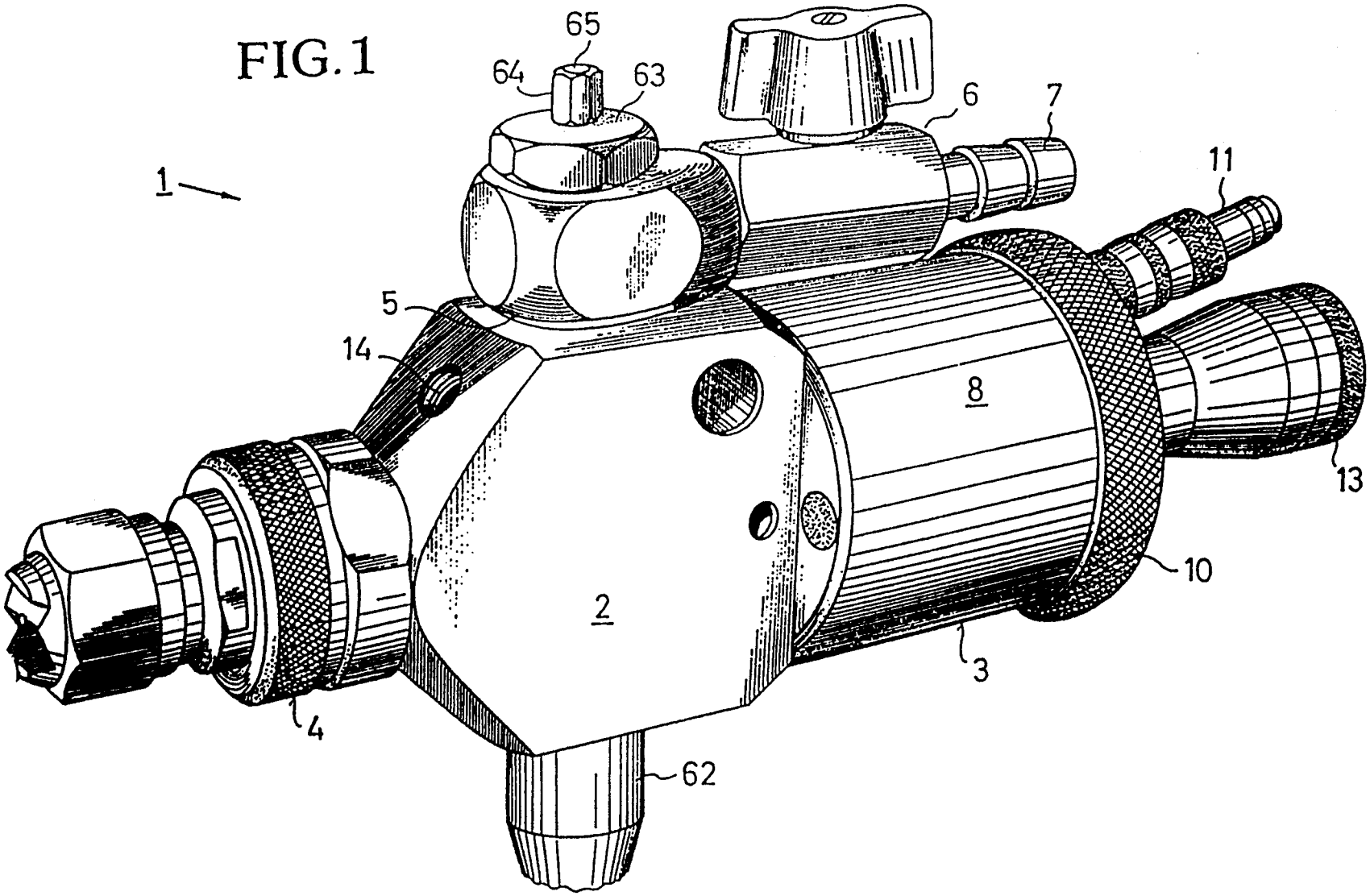

The invention relates to a dosing gun, in particular a high-pressure dosing gun for spraying a medium such as polishing paste.

In patent DE-C-22 04 942, a high-pressure dosing gun is described for the first time in which a pressure determining the motion of the valve body such as a valve piston is generated by a compressed air motor in a supply chamber containing the medium to be sprayed, such as polishing paste. To do so, the medium encloses the valve piston at least in the area of the valve seat, such that the valve piston is at a distance from or in contact with the valve seat depending on the prevailing pressure, in order to thereby spray or retain the medium as required.

When the medium is sprayed without the supply of air, this is referred to as the "airless" method. Before the medium can be sprayed, it is necessary to bleed the high-pressure dosing gun. To do so, separate valves are necessary in some cases or the air present is ejected too at the start of spraying, with the result that there is no reproducible output of the medium at this time.

German patent DE-A-32 02 189 describes a high-pressure dosing gun in which the valve body is arranged fixedly and the spring-pressure-loaded nozzle containing the valve seat can be in contact with or at a distance from the valve piston. The spring surrounds the nozzle coaxially and is fixed by a cap nut. A design of this type has proved to have major drawbacks. A further drawback of this gun design is that the sealing action is between the valve body and a section of a cylinder element containing the nozzle, said section being movable relative to the valve element, so that a relatively large sealing area is obtained from which high forces result, which in their turn must be compensated or balanced by a spring element with correspondingly high force. The result is the risk that even with minor leaks from the valve seat or from the seal itself an internal pressure can build up which is no longer sufficient to move the cylinder element. It is of major importance, particularly when using or operating with abrasive media such as polishing paste, for the valve arrangement to be sufficiently open, since otherwise a self-destructive effect as a result of uneven washing out at the valve seat or valve shank will occur in spite of the use of carbides or similar, thereby further accelerating wear. In addition, the manual opening necessary for putting into service the valve arrangement for bleeding the system is only possible with an additional special tool. The sensitivity necessary for operating an arrangement of this type with atomizer air is inadequate for achieving the consistent high level of dosability required. This is not achievable with the device shown in DE-A-32 02 189.

High-pressure dosing guns of this type have the further drawback that frequent changing is necessary of wear parts such as the valve body or valve element containing the valve seat, such as the perforated disk. In addition, design drawbacks may then be present if the valve body is designed as a hollow needle through which flows the medium to be sprayed.

The object of the present invention is, among others, to develop a dosing gun such that replaceability of the wear parts is reduced, and high reproducibility of the sprayed media is achieved by simple design means, where small sealing surfaces must be selected in particular for better control of the forces generated. In addition, simple replacement of any worn parts should be possible. Finally, it should also be possible to operate the dosing gun with the "airless" method or with a compressed air supply as required. A further object of the present invention is to achieve bleeding with simple means, with both rapid bleeding and if necessary continuous bleeding being possible. In addition, the nozzle should be adjustable with simple means without the need for cap nuts or similar that have to be tightened.

The invention is particularly noteworthy in that the valve body is mounted detachable from a first casing combining with it to form a unit, in that the first casing extends from the cartridge element or the housing, and in that the valve seat is provided in the frontal part of a hollow cylinder which is movable relative to the first casing and which forms a unit with a second casing movable against the spring element and opposite the first casing. Here, the valve body in particular can be flowed around by the medium and is supported against the first casing by spacer elements, which in their turn are an integral part of the valve body. In particular, it is provided that the valve body with the spacer elements is designed symmetrical with regard both to the main axis and to the secondary axis. The same applies with regard to the hollow cylinder containing the valve seat.

The second casing holding the hollow cylinder has one or more leak holes, which firstly prevent medium penetrating between the hollow cylinder and the first casing from collecting and impairing the movability of the arrangement, and secondly showing that inspection of the seal and of the hollow cylinder/valve seat is necessary.

The last-named features in particular have the advantage that the wear parts revolve to allow double the use in comparison with known devices. In other words, a revolving valve body and a revolving hollow cylinder are provided whose frontal parts each have a valve seat. The first working chamber containing the medium and situated between valve seat and valve body is sealed on the outside of the hollow cylinder, preferably using a grooved ring. Consequently, only a small sealing surface is necessary, so that the forces generated can be better controlled.

In an embodiment, a second working chamber between radially running sections of the first and second casings is designed such that when compressed air is admitted it can be moved against the force of the spring element, with a connection being in existence between the working chamber and the outlet channels in the area of the nozzle. In other words, the dosing gun in accordance with the invention can be operated both in the "airless method" and with compressed air supplied.

The hollow cylinder containing the valve seats has on its front a nylon seal tapering outwards in some areas, that can be applied to the inner face of the nozzle. A suitably designed section of the second casing is adjusted to the external geometry of the nylon seal, and a cap nut tightening the nozzle in the direction of the seal can be screwed on to the outside of said casing. This ensures firm positioning of the hollow cylinder with seal and nozzle relative to the second casing, which surrounds the first casing in some areas and is movable along it.

The second casing is in its turn surrounded by a further cap nut extending from the cartridge element or housing. The spring element applying pressure to the second casing in the direction of the housing runs in the area between the second cap nut and the outside of the second casing. A stop is provided preferably in the front end of the second cap nut to limit the axial movement of the second casing and hence of the valve seat away from the housing or valve body.

In a dosing gun in which the valve body is designed movable against the force of a spring element relative to the cartridge element or housing, the invention proposes that the nozzle is held by the cap nut so as to be rotatable and axially movable against the force of the spring element. In addition, a disk element holding the valve seat is designed to be in floating contact with the nozzle.

The theory according to the invention permits the generation, by means of a tool such as a conventional screwdriver, of a lever effect between the cap nut to be designated as nozzle nut and the nozzle itself, this effect moving the lever into the interior of the high-pressure dosing gun. As a result, the air in the lines of the device and in connected hose lines is allowed to escape. As soon as the tool is removed, the valve arrangement closes automatically, i.e. the valve body is again up against the valve seat, so that an adequate sealing effect is achieved.

In a further embodiment, the first cap nut holding the nozzle is fastened to a further cap nut that screws to the cartridge element or dosing gun housing, and the front orifice of the further cap nut facing the first cap is matched to the diameter of the contact collar of the nozzle. This part is designed slightly projecting beyond the adjacent section of the second cap nut, so that on the inside the valve element such as the perforated disk can contact it. The resultant advantage is that when the nozzle is removed, i.e. when the first cap nut is unscrewed, the valve body remains in contact with the valve seat, so that adequate sealing against uncontrolled spraying of the medium is ensured since the valve disk is held by the front section of the second cap nut.

The valve body itself is preferably movably mounted in a valve piston guide having an internal replaceable wear bush interacting with the valve body.

The sealing effect in the first working chamber containing the medium and situated between the valve seat and the valve body is achieved by an all-round seal provided in the area of the wear bush in the wall of the valve body. Here too, only a small sealing surface is needed, so that sensitive opening and closing of the nozzle is ensured.

Substantial parts of the valve arrangement such as valve body, valve piston guide, wear bush and a spring plate interacting with the spring element are only fitted. All parts are easily removed and replaced once the second cap nut has been removed. This facilitates maintenance of the dosing gun.

In addition to the possibility in accordance with the invention of simple nozzle adjustment, it must also be noted that the airless nozzles usually used do not spray a round jet in most cases, but a fan-type one. In this case, therefore, the nozzle must be aligned radially. In known devices, the nozzle is tightened at its fastening collar with the aid of a cap nut, which as a rule must itself be held with a separate wrench to stop it turning as well. Using the theory according to the invention, these expensive measures are no longer necessary, since the force of the spring element acts right through the spring plate, the valve piston and the valve seat to the contact collar of the nozzle, and the nozzle is in sealing contact with the wall of the cap nut facing it. The nozzle can be turned to any required position, using for example an open-jaw wrench engaging in a wrench surface provided on the nozzle without the need to loosen beforehand and subsequently retighten the cap nut.

In order to operate a dosing gun with and without compressed air supply, the valve body is surrounded at least in sections by a hollow guide cylinder, the valve body and the hollow guide cylinder are movable relative to one another, a valve element containing the valve seat is fixed between the hollow guide cylinder and the nozzle, and a further working chamber is arranged between the hollow guide cylinder and an element connected thereto and an element holding the valve body or extending therefrom, said working chamber being acted upon by compressed air for adjustment of the valve body relative to the valve element, the further working chamber being connected to the air outlet channels in the area of the nozzle.

With the dosing gun in accordance with the invention, it is possible to perform various spraying and dosing processes as required without alteration of the basic structure. The dosing gun is suitable for aggressive, abrasive, low-viscosity and high-viscosity materials. The further working chamber is or is not connected to a compressed air source depending on the type of spray operation selected The integral parts of the dosing gun are simple in design and therefore economically producible. the entire dosing gun strips down quickly and easily, meaning that wear parts subjected to heavy wear from abrasive materials can be replaced quickly and easily.

The invention is described in more detail in the following on the basis of preferred embodiments shown in the drawings, in which further details, advantages and features are shown.

Figure 2:
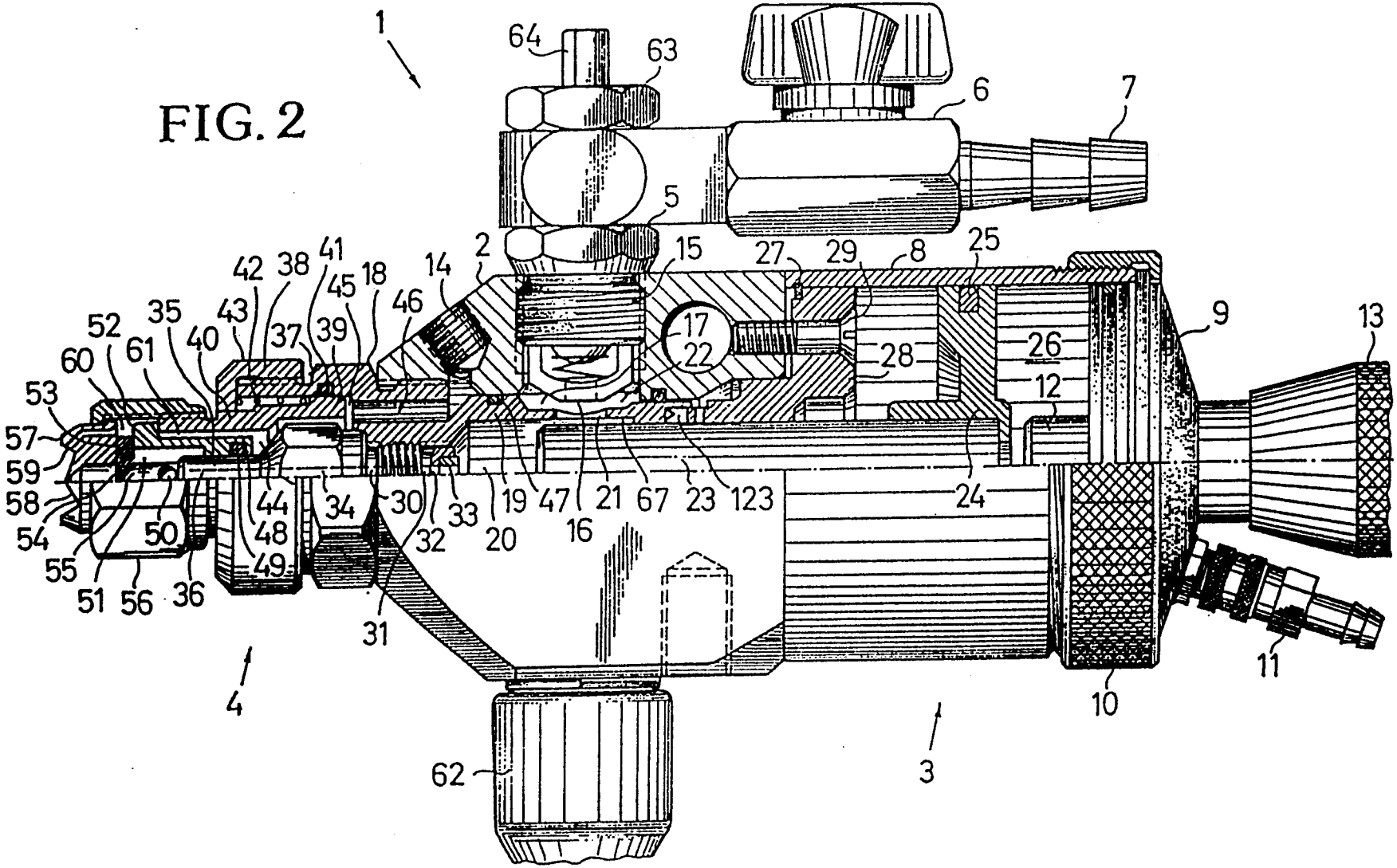
Figure 3:
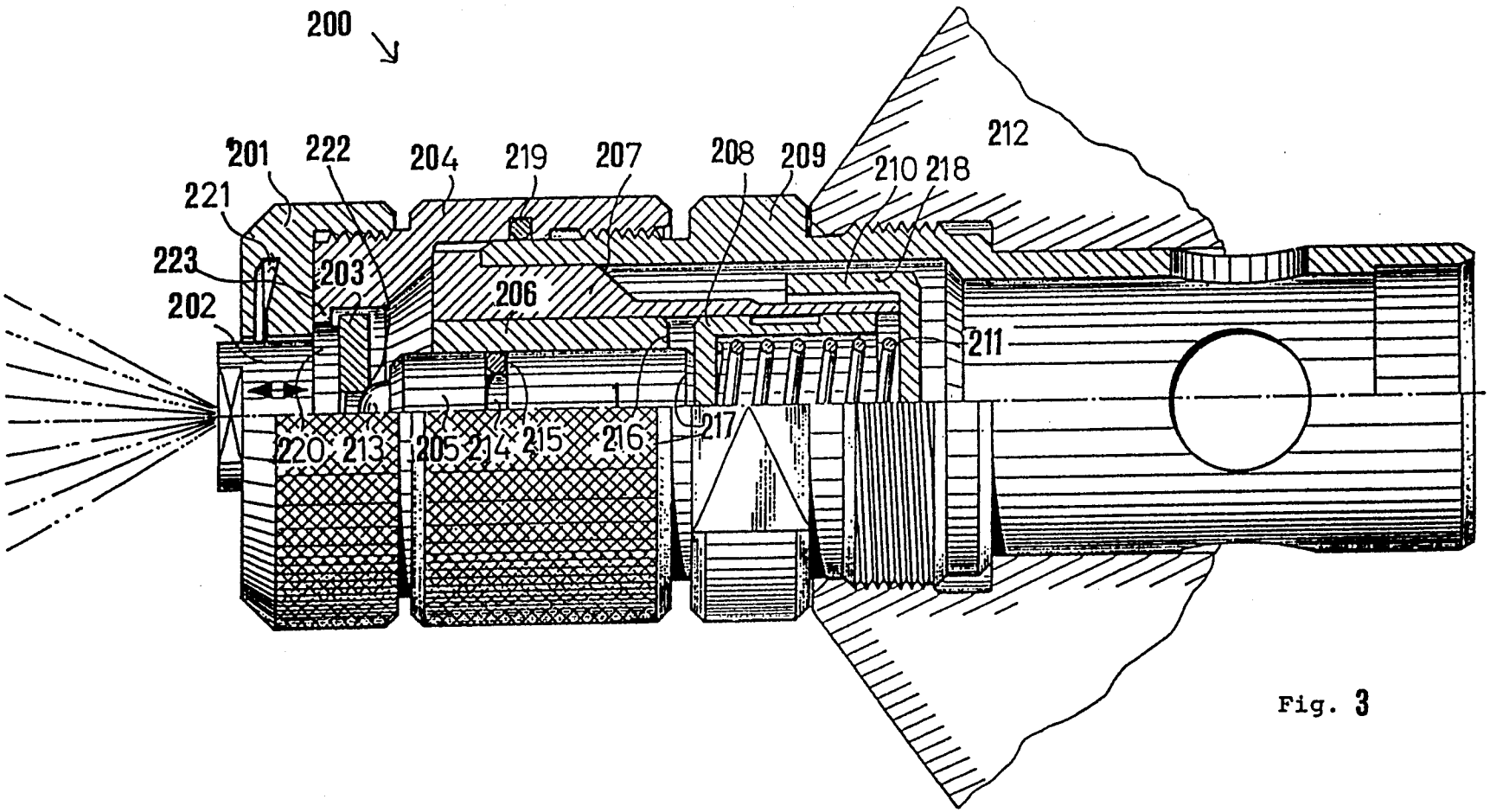
Figure 4:
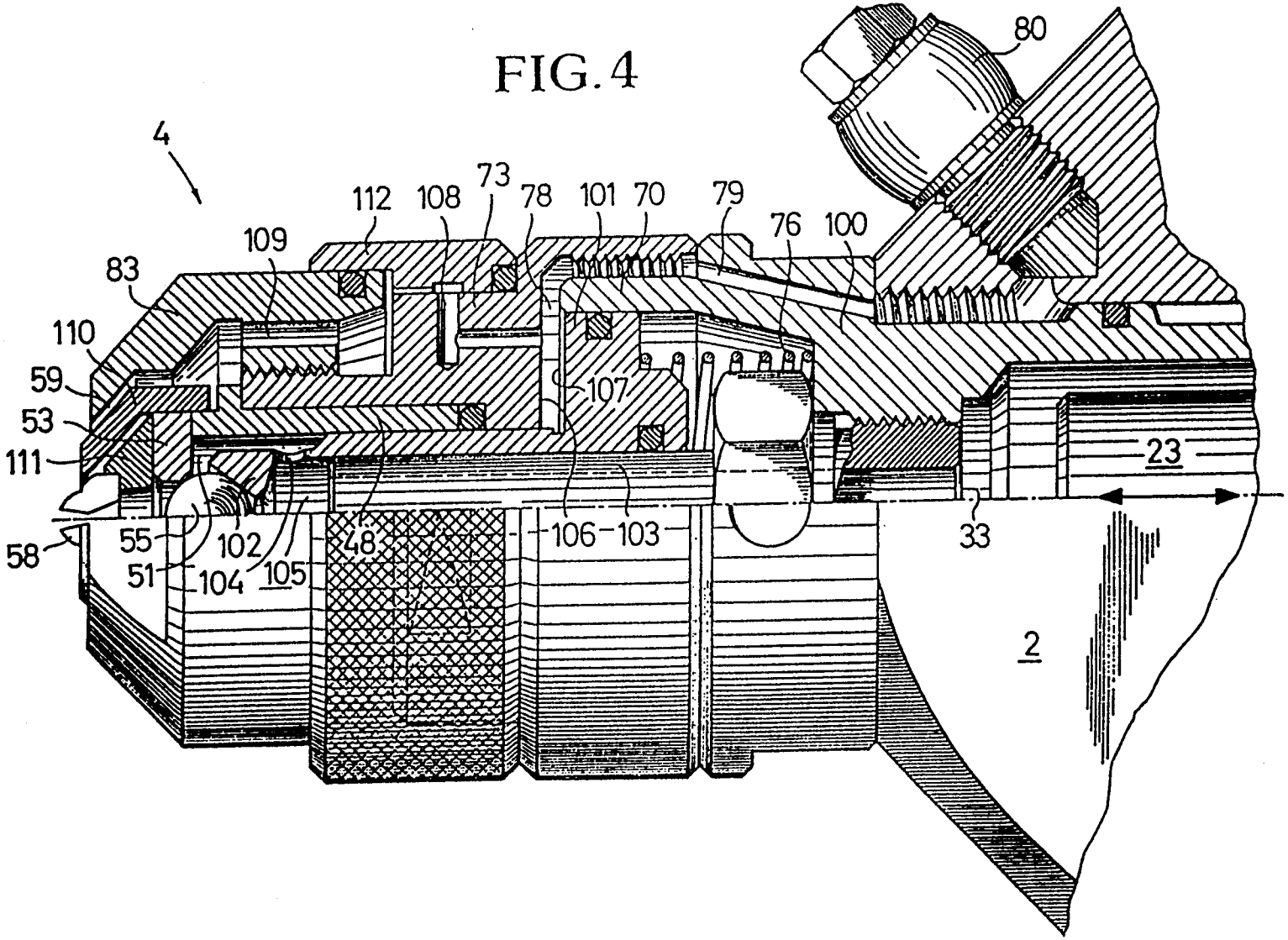
Figure 5:
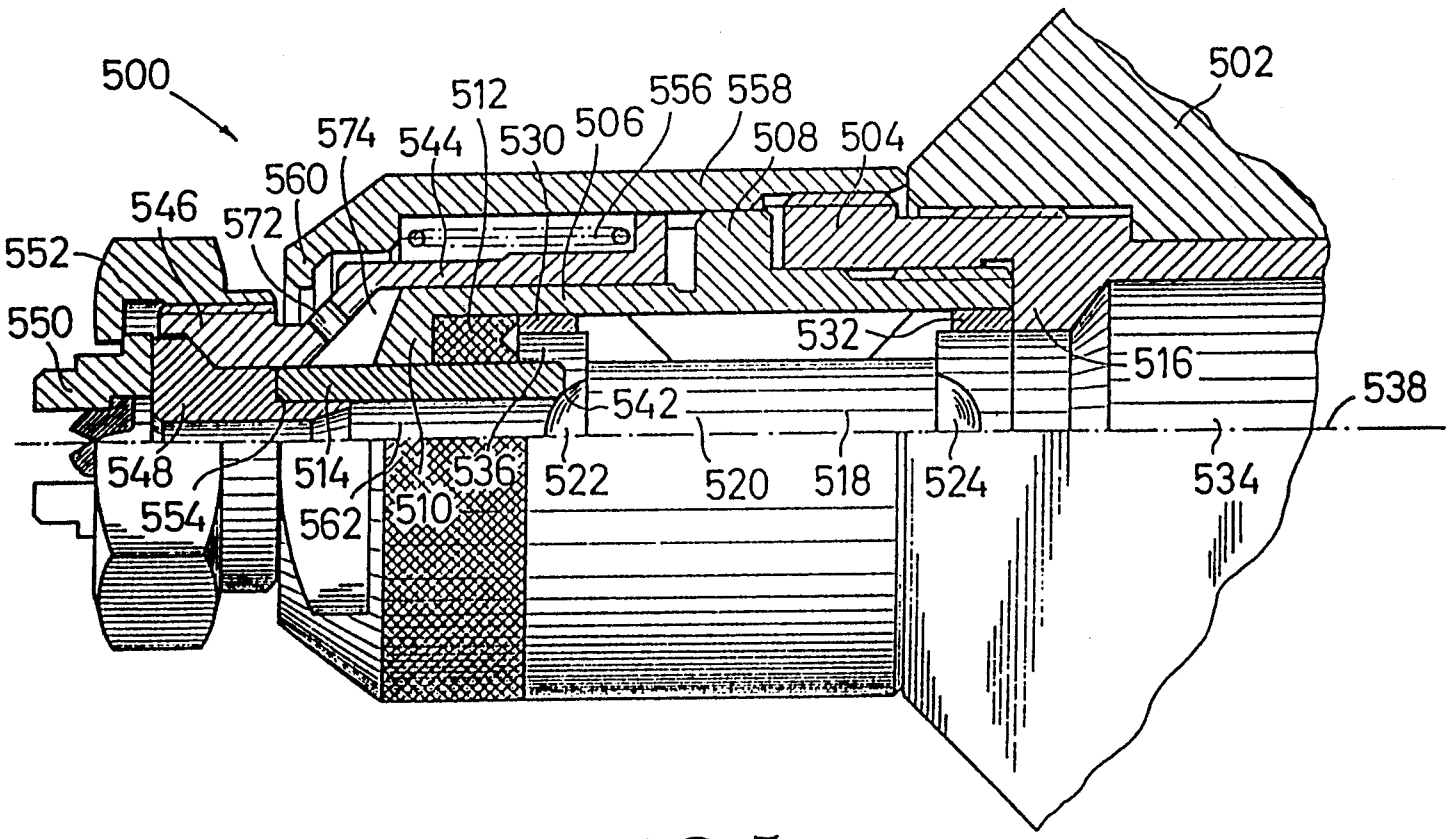
Figure 9:
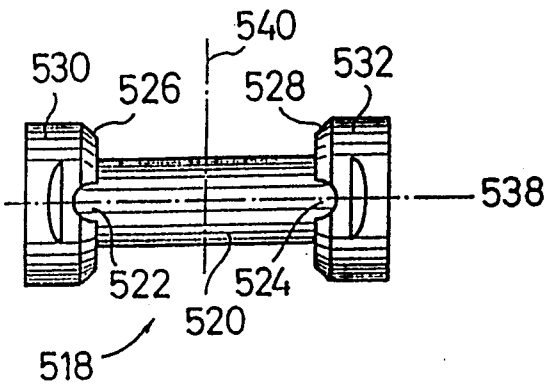
Figure 6:
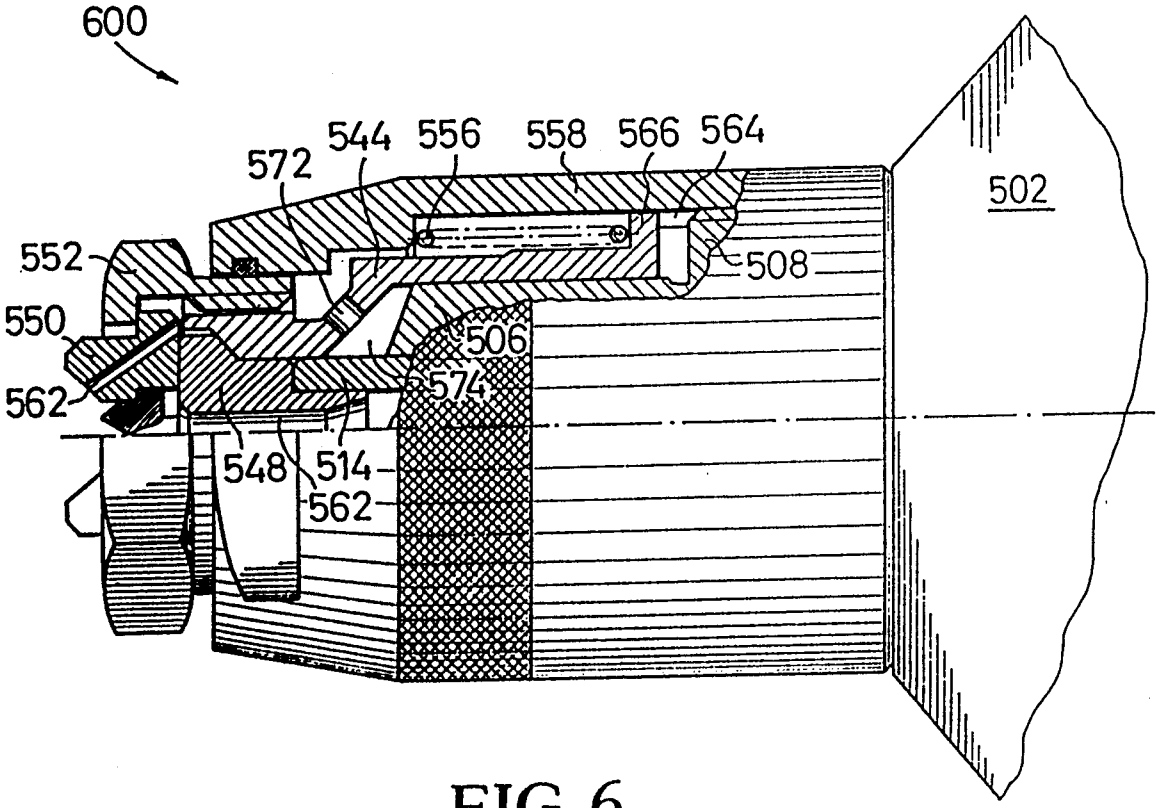
Figure 8:
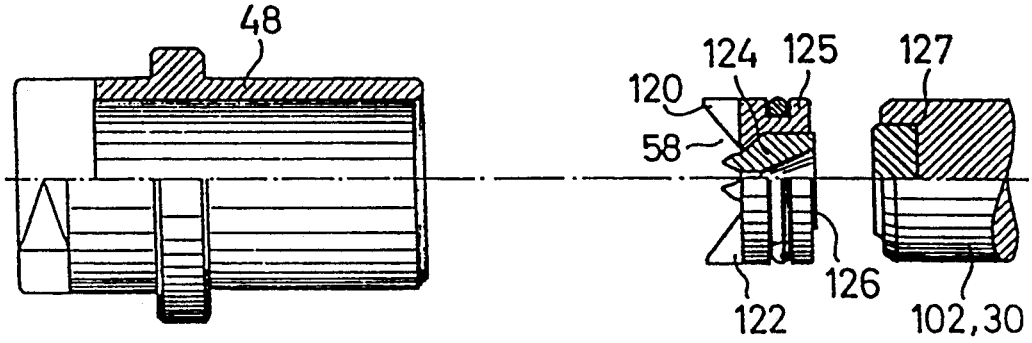
Figure 7:
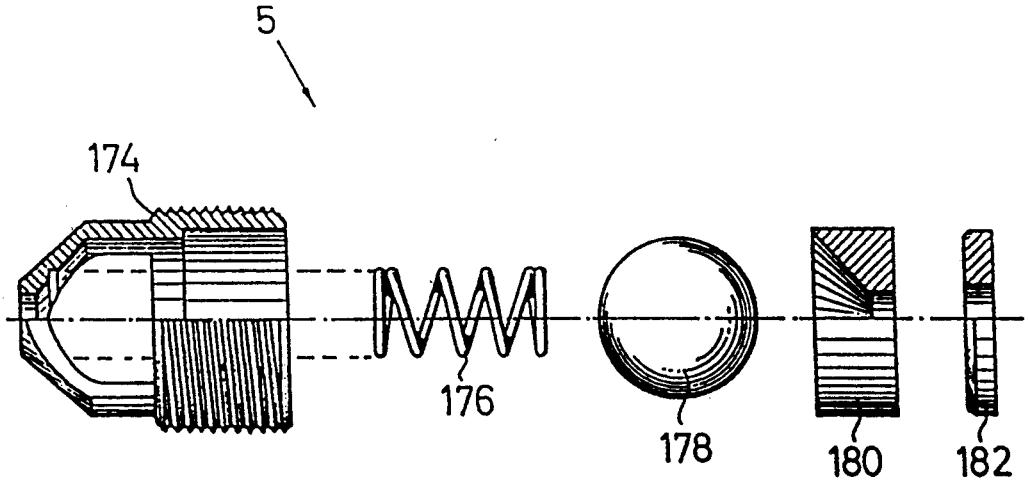

FIG. 1 shows a first embodiment of a dosing gun shown in perspective,

FIG. 2 shows the dosing gun according to FIG. 1 in side view, partially in longitudinal section, FIG. 3 shows a second embodiment of a dosing gun, FIG. 4 shows a third embodiment of a dosing gun with axially movable valve body, FIG. 5 shows a particularly noteworthy embodiment of a dosing gun, FIG. 6 shows the dosing gun according to FIG. 5, but with compressed air supply, FIG. 7 shows in detail a check valve, FIG. 8 shows in detail a valve arrangement intended for a dosing gun, and FIG. 9 shows a particularly noteworthy embodiment of a valve arrangement in the form of a revolving element.

FIGS. 1 and 2 show a dosing gun (1) for spraying of liquid or pasty material, i.e. materials having different viscosities. The dosing gun (1) contains a housing (2) with whose one side a compressed-air piston cylinder arrangement (3) is connected. On the opposite side of the housing (2), a valve arrangement (4) is provided. On another side of the housing, a check valve (5) is attached. A shut-off cock (6) is connected to the check valve (5) and has a connection (7) for a hose not shown in detail and leading to a source for the pressurized spray material. The compressed-air piston cylinder arrangement (3) contains a hollow cylinder (8) closed on one side by a sealed disk (9) and fastened by a cap nut ( 10) to the cylinder (8).

A connection for a hose not shown in detail is fastened in the disk or cover (9) and is connected via a control valve, in particular a three-way valve, also not shown in detail, to a compressed air source for low pressure in particular. In the middle of the disk (9), a stop spindle (12) is arranged having an adjusting nut (13), disposed outside the compressed-air piston cylinder arrangement (3), with which the axial insertion depth of the stop spindle (12) in the interior of the cylinder (8), hereafter referred to as hollow cylinder (8), can be adjusted.

The shut-off cock (6) has an actuating handle not shown in detail. In the housing (2) is a threaded hole (14) for screwing in a further connection not shown in detail which is connected via a hose also not shown in detail to the mentioned compressed air source or to a further source.

A hollow threaded spigot (15) of the check valve (5) is screwed into a tapped hole not designated in detail of the housing (2). This tapped hole tapers at that end arranged in the housing (2) and is connected via an orifice (16) to a cylindrical cavity (17) extending through the housing and having at its ends sections of larger diameter not designated in detail. One of these sections located on that side of the cavity (17) facing away from the compressed-air piston cylinder arrangement (3) has a female thread. Into this female thread is screwed a cartridge-type insert (18) which has a section (19) projecting into the cavity (17) in which a cylindrical supply chamber (20) is arranged that is connected via a passage (21) in the section (19) to a free space (22) in the cavity (17). The orifice (16) opens into the free space (22).

A rod (23) is arranged in a longitudinally movable manner in the supply chamber (20), and its end facing away from the supply chamber (20) is held in a piston (24) mounted movably in the interior of the hollow cylinder (8). A seal (25) is arranged in the cylindrical wall, not designated in detail, of the piston (23). The piston (24), the inner wall of the hollow cylinder (8) and the disk (9) surround a working chamber (26) which is accessible to gases via the connection (11).

The hollow cylinder (8) is closed off at its end facing away from the disk (9) with a circular flange (28) inserted into the cylindrical cavity and fastened with a lock ring (27), said flange having a passage orifice not designated in detail for the rod (23). The flange (28) contains holes not designated in detail disposed parallel to the longitudinal axis of the hollow cylinder (8), into which holes the screws (29) are inserted that are screwed into the tapped holes of the housing (2). The flange (28) and the housing (2) are both provided with aligned leakage holes not designated in detail. Furthermore, bleed holes not designated in detail are provided.

The cylindrical supply chamber (20) tapers at one end to a tapped hole on the same axis, not designated in detail, into which is screwed a hollow needle (30), also designated as the valve body, having an end section (31) provided with a male thread. The hollow needle (30), which has a central channel (32) running in the longitudinal direction, belongs to the valve arrangement (4). At the outlet of the channel (32) into the supply chamber (20), a closing seal (33) is inserted into a recess. The hollow needle (30) contains a central section (34) provided with an integrally cast nut head, adjacent to which section is the second end section (35) having cylindrical form, the outside of which is designed at least partially as a guide surface (36).

The insert (18) projects with one section (37) beyond the housing (2). In the inside of the section (37) is a hollow cylinder (38) which forms a guide surface for a section (39) of a sliding element (40). A seal (41) is arranged in the wall of the cylinder (38). The sliding element (40) tapers radially in steps towards the section (39), thereby creating a free space between the wall of the cylinder (38) and the sliding element (40). A coil spring (42) is inserted in this free space, one end of which is supported by the ring-shaped wall of the step on section (39). The other end of the coil spring (42) is supported in a cap nut (43) screwed onto a male thread of section (37) and having a central passage for that part of the sliding element (40) projecting beyond the section (37). The sliding element (40) is provided in its interior with a cavity (44) in which is located the central section (34). The wall facing the housing (2) of section (39) forms together with the walls of the cylinder (38) a further working chamber connected via a channel (46) in the insert (18) to the tapped hole (14). In section (19), a seal (47) is provided that seals the channel (46) and the working chamber (45) against the space (22) in which the material to be sprayed is located. The cavity (44) tapers to a cylindrical guide surface (48), i.e. to a so-called hollow guide cylinder, which surrounds the guide surface (36) on the valve body (30). A seal (49) is arranged in the guide surface of the hollow guide cylinder (48).

The channel (32) is angled outwards radially in the vicinity of that end of the hollow needle (30) projecting from the housing (2) and has an outlet into a cavity (51) formed by a cylindrical recess in the sliding element (40). The diameter of this cavity (51) is greater than the diameter of the hollow guide cylinder (48). The cavity (51) extends to the front (52) of the sliding element (40).

A valve plate (53) closing the front orifice of the cavity (51) and having a central passage orifice (54) contacts the front end (52). The edge of this passage orifice (54) is designed as a valve seat surface for a valve head (55) located at that end of the valve body (30) or hollow needle that projects from the housing (2). The valve head (55) can be an integral part of the hollow needle (30). It is also possible to attach a separate valve head (55) to the end of the hollow needle (30). The valve head (55) is preferably of spherical or hemispherical design.

The sliding element (40) is provided at its end facing away from the housing (2) with a male thread not designated in detail and onto which is screwed a cap nut (56) that presses an insert (57) with a nozzle (58) against the valve plate (53) and the latter against the front face (52).

The insert (57) contains in addition to the nozzle (58) air outlet channels (59) running to an annular cavity (60) arranged between the inner face of the insert (57), the cap nut (56), the valve plate (53) and the front face (52). The annular cavity (60) is connected via a channel (61) to the cavity (44).

Above the check valve (5) is a nut-type screw union (63) at the deflection point of the material conveying channel leading to the shut-off cock (6). In a continuation (64) of the screw union (63) is a pressure sensor, not designated in detail, that has an optical display element (65) for pressure. If necessary, electrical pickup and, for example, digital display of the pressure is possible.

A further pressure sensor (62) is connected with a sensor element in the interior to the supply chamber (20). The pressure readings can be electronically evaluated and used to monitor the function of the entire system.

As regards FIG. 2, it may be noted in addition that the hydraulic unit comprising the cartridge and the valve arrangement is separable from the compressed-air motor by a grooved ring (123), thereby permitting easier maintenance.

Six different spraying methods are feasible with the device described above, and are described in detail in the following.

1. For continuous spraying of a material, the insert (57) described in greater detail in conjunction with FIG. 2 is used. The tapped hole (14) is connected to the compressed air source via a three-way valve not shown in greater detail. The working chamber (26) is connected to atmospheric air pressure via the connection (11). Compressed air passes through the tapped hole (14) and the channel (46) to reach the working chamber (45). From there, the compressed air flows via the cavity (44) and channel (61) to the annular cavity (60) from which it escapes via the air outlet channels (59) surrounding the nozzle (58) at regular intervals. The annular end facing the working chamber (45) of section (39) has been designed sufficiently large to match the air quantity coming from the air outlet channels such that the pressure building up in the working chamber (45) is sufficient to move the sliding element (40) against the force of the coil spring (42) by a small amount, e.g. 2 mm. As a result the valve plate (53) is lifted off the valve body (55). A passage is obtained at the valve containing the valve plate (53) and valve body (55). The sprayed material is conveyed under pressure to the supply chamber (20) and flows from there through the channel (32) into the cavity (51). Spray material therefore passes continuously through the orifice of the valve to the nozzle (58) from which the medium comes out and passes to the range affected by the compressed air coming from the air outlet channels (59) and forming together with the medium an air/material mix which can be applied under pressure as a spray mist onto an object.
2. It is also possible with the dosing gun (1) shown in FIGS. 1 and 2 to spray a viscous material having a precisely preset volume determined by the axial position of the stop spindle (12). A scale not shown in detail on the adjusting nut (13) displays the volume of the supply chamber (20) that can be set using the stop spindle (12). The connection (11) is connected to the compressed air source using, for example, a three-way valve in the same way as for the tapped hole in order to achieve the aforementioned method. Under the pressure with which the spray material is conveyed, the supply chamber fills up with the material until the piston (24) is up against the stop spindle (12). A spring for retracting the piston (24) to its one limit position is therefore unnecessary. The working chambers (26) and (45) are then supplied with compressed air that spreads evenly to working chambers (26) and (45). The valve arrangement (4) operates in the same way as already described. The piston (26) slides the rod (23) into the supply chamber (20), as a result of which a pressure builds up in this chamber by which the check valve (5) is closed. Therefore no further material is fed into the supply chamber (20). The rod (23) displaces the viscous material present in the supply chamber (20), and the material flows via the channel (32) and the valve to the nozzle (58) until the front face of the rod (23) is up against the closing seal (33). The working chambers (26) and (45) are then subjected to atmospheric air pressure. As a result, the valve arrangement (4) closes and the check valve (5) opens. Material again passes under pressure via an annular chamber (67) in the supply chamber wall to the front of the rod (23), which is forced out of the supply chamber (20) by the material flowing into the latter until the piston (24) contacts the stop spindle (12). The sequence described above can then be repeated.

The compressed air supply to the working chamber (26) can be reduced by an air intake butterfly valve not shown in detail, to allow the pressure in the working chamber (26) to become just high enough for the check valve (5) to close and the rod (23) to move to the closing seal (33).

3. Continuous spraying at low pressure without compressed air supply using the material conveying pressure (mottling) is based on the assumption that no air outlet channels (59) are present. A corresponding insert without air outlet channels (59) is installed in the gun (1), for example. It is also possible to provide a seal in the annular cavity (60) by which the air outlet channels (59) are sealed. The compressed air passes into the working chamber (45) and moves the sliding element (40) into the valve opening position against the force of the coil spring (42). Material can now pass from the supply chamber (20) via the channel (32) and the cavity (51) to the open valve, from which it passes over into the nozzle (58). The material quantity leaving the nozzle per unit of time depends on the pressure in the supply chamber (20) or the material conveying pressure. The duration of spraying is preferably controlled by a time-lag relay with which the supply of compressed air to the working chamber (45) is interrupted, as a result of which the valve arrangement (4) closes.
4. Volume dosing during spraying at low pressure without compressed air supply using the material conveying pressure (mottling) is achieved when the working chamber (26) is supplied with compressed air in the same way as described in item 2. In order not to generate too high a pressure in the working chamber (26), the air supply is restricted when the preset material quantity is forced out of the supply chamber (20).
5. For high-pressure spraying of the material without compressed air supply, the working chamber (45) is subjected to atmospheric pressure.

The working chamber (26) is connected to compressed air by a control valve not shown. The pressure in the working chamber (26) allows the piston (24) to move the rod (23) into the supply chamber (20), in which a pressure is thereby generated that closes the check valve (5). A further movement of the rod (23) leads to an increase in pressure in the supply chamber (20), the channel (32) and the cavity (51) until the pressure acting on the valve plate (53) exceeds the spring pretension. As a result, the sliding element (40) is slid into the opening position of the valve arrangement (4). The material coming out of the valve passes to the nozzle (58) and leaves the latter at high pressure, whereby it is atomized. As long as high pressure is present in the material, the valve arrangement (4) remains open. When the piston (20) meets the flange (28), the pressure drops rapidly so that the valve arrangement (4) closes. The high pressure necessary for airless atomization is generated by the piston (24), which has a larger working surface than the rod (23).

6. Under certain conditions, it is necessary to exercise a further effect on high-pressure (airless) atomization by adding compressed air within certain limits. This process is called the airless method with air assistance. In this method, the working chambers (26) and (45) are simultaneously acted upon by compressed air. The insert (57) again contains air outlet channels (59) in addition to the nozzle (58). However, a butterfly valve is arranged between the tapped hole (14) and the compressed air source. Initially, the compressed air supply to the working chamber (45) is, for example, without pressure or closed. When the compressed air supply to the working chamber (26) is released, a pressure builds up in the supply chamber (20) that continues in the manner described in item 5 up to the cavity (51) and opens the valve arrangement (4). It is then possible for compressed air to be supplied via the working chamber (45) by opening the butterfly valve to the cavity (44) and the channel (61), and to the annular cavity (60) and the insert (57), this compressed air being supplied with the atomized material. A spray mist is thereby affected in the manner required. The further the butterfly valve is opened, the less air and pressure is available for the working chamber (26), so that the high pressure generated by the piston (24) can be reduced parallel thereto. The pressure present in the expansion area also drops, and the valve arrangement (4) could close if necessary, which is however compensated by the compressed air affecting the sliding element (40) via the working chamber (45) and building up sufficient pressure to keep the valve arrangement (4) open.

The stroke of the rod (23) ends at the seal (33) and is set to a required value by the stop spindle (12) as in the dosing method described under 2. and 4.

FIG. 3 shows, in purely diagrammatic form and partly in section, part of a further embodiment of a dosing gun, in particular a high-pressure dosing gun (200), having a cartridge element (209) detachably insertable into a gun element (212). The gun element (212) contains a compressed air motor not shown, for example of the type described above, in order to generate a pressure of the required quantity by movement of a rod movable inside a supply chamber holding the spray material. The spray material, such as polishing paste, extends in the drawing in the dash-lined area up to a valve head (213) of a valve body such as a valve piston (205). The valve piston (205) is arranged axially movable in a valve piston guide (207) enclosing a wear bush (20) and along which the valve piston (205) is movable. The sealing action between the valve piston (205) and the wear bush (206) is achieved by a seal (215) placed in a groove (214). The wear bush forms, together with its rear annular end wall (216) a stop for a spring plate (208) of which the rear end wall (217) interacts with the valve piston (205). The spring plate (208), which is opened in the direction of the gun element (212), holds a compression spring (211) that rests on a cover (210) that is fixed substantially immovable by contact with, for example, a stop not shown when the dosing gun (200) is assembled. The cover (210) has a U-shaped section, and the continuous edge (218) extending in the direction of the spring plate (208) is sealed off from the valve piston guide (207) of hollow cylinder form. The force exerted by the spring (211) perceptibly effects a movement of the spring plate (208) and hence of the valve piston (205) in the direction of a nozzle (202) which is held by a first cap nut or nozzle nut (201). The nozzle nut (201) is in its turn screwed to a second cap nut (204) which surrounds some areas of the outside of the cartridge element (209). The sealing action between the cap nut (204) and the cartridge element (208) is achieved via a statically acting O-ring seal (219).

The nozzle (202) has a contact collar (220) resting against the inner face of the first cap nut (201). A valve element such as a perforated disk (203) containing a valve seat (222) is mounted in floating fashion between the valve head (213) of the valve piston (205) and the contact collar (202).

The valve piston (205) can be lifted off the valve seat (203) against the force exerted by the spring (211) depending on the pressure prevailing in the area of the valve head (213) generated by the compressed air motor and transmitted via the spray material. This permits spraying of the medium by the nozzle (202).

The front part of the second cap nut (204) has a section (223) extending radially inwards whose clear diameter is greater than that of the contact collar (220), but smaller than that of the perforated disk (203).

The mode of operation of the features in accordance with the invention of the high-pressure dosing gun (200) is as follows.

The nozzle (202) held by the first cap nut or nozzle nut (201) can be pressed against the perforated disc (203) by means of a screwdriver insertable into a recess (221) provided in the nozzle nut (201), as a result of which the nozzle (202) is moved inwards. The floating-mounted perforated disk (203) containing the valve seat (222) and in contact with the nozzle (202), including the valve piston (205), is thereby moved against the force of the closing spring (211). The lifting of the contact collar (220) of the nozzle (202) from the inner face of the nozzle nut (201) ends the sealing action on the inner face of the nozzle nut (201), so that the air in the valve arrangement can escape past the nozzle jacket. When the tool is removed from the recess (221), the valve arrangement closes automatically, since the force of the spring (211) has the effect that the spring plate (208), via the valve piston (205) and the valve seat (202) or perforated disk (203), exerts a force on the contact collar (220) for sealing contact with the cap nut (201).

If continuous bleeding is required, the cap nut (204) is loosened from the cartridge element (209) until the spring plate (208) is in contact with the stop (216) of the wear bush (206). If the cap nut (204) is further unscrewed, the spring force can no longer act on the valve piston (205), so that the closing force of the valve piston (205) or valve head (213) at the valve seat (222) is neutralized and hence any air can escape through the perforated disk (203) and the nozzle.

If the nozzle nut (201) is now removed with the nozzle (202) for replacement, the interior of the dosing gun (200) remains sealed, i.e. can remain under pressure. The cause of this is that the perforated disk (203) is still in contact with the inner face of the section (223) projecting radially inwards of the second cap nut (204). As a result, the valve head (213) is tight against the valve seat (222) and seals the inner cavity.

FIG. 4 shows further particularly noteworthy embodiments of the invention. The same reference numbers have generally been taken for elements already shown in FIGS. 1 and 2.

From the housing (2) projects a hollow cylinder section (70) extending in the direction of the valve arrangement (4). The hollow cylinder section (70) can here also be an end section of a cartridge (100) projecting from the housing (2), said cartridge being detachably arranged in the housing (2) but remaining stationary relative to the housing (2) when the spraying unit is operated. Housing (2) and cartridge (100) can also be designed as a unit. A piston (101) is designed to be movable inside the hollow cylinder section (70). The piston (101) of the embodiment according to FIG. 4 represents a section of the valve body (101) designed movable relative to the hollow guide cylinder (48). The valve body (102) is substantially designed as a long hollow cylinder which in its turn surrounds a hollow needle (103) firmly screwable to the cartridge (100) or housing (2) and opening to the supply chamber (20). The hollow needle (103) also designated as hollow spigot is provided in the supply chamber with the seal (33) to which the displacement piston (23) can be applied at maximum stroke. The spray material can now be forced through the spigot (103) in order to flow via a radial orifice (104) into the cavity (51) between the hollow guide cylinder (48) and the outside of the valve body (102). Depending on the prevailing pressure there, the valve head (55) then lifts off from the valve seat (53). The orifice (104) therefore represents the connection between the chamber (105) and the cavity (101), the former being limited by the inner wall of the valve body (102) and the front face of the spigot (103).

The hollow guide cylinder (48) in its turn is held by a hollow cylinder (73) screwable onto the housing hollow cylinder section (70). The pot-shaped end section (83) of the valve arrangement (4) and a further cap nut (112) with pressure regulation effect are in turn screwable onto the hollow cylinder (73).

Between the wall (106) facing the piston (101) of the hollow cylinder (73) holding the hollow guide cylinder (48) and in its turn firmly connected to the hollow cylinder section (70) of the cartridge (100) or housing (2), and the valve-side front face (107) of the piston (103), the further working chamber (78) is provided that is connectable via the channel (79) to the compressed air connection (80), in order to move the piston (101) against the force of the spring (76) depending on the prevailing pressure, and thereby lift the valve body (102) from the valve seat (53). Channels (107) and (109) extend from the working chamber (78) and open into the air outlet channels (59). It is possible in accordance with the embodiment in FIG. 4 for the air outlet channels (59) for spraying the medium coming out of the nozzle (58) to run between the pot-shaped end section (83) and a centering cap (110) which in its turn holds the nozzle (58). Furthermore, a truncated-cone-shaped seal (111) preferably of polymer is located between the nozzle (58) and the valve seat (53).

By adjusting the regulating ring (112), the connection between the channels (108) and (109) can be altered so that more or less compressed air is emitted via the air outlet channels (59).

The movement of the sliding element (102), which according to the invention provides a rigid unit with the piston (101) movable against the spring (76) exerting a force directed away from the housing (2), can take place exclusively and/or assisted with compressed air.

FIG. 8 shows a preferred embodiment of the guide cylinder (48), also designated as wear bush, with the material nozzle (58) held by it. The material nozzle (58) can thus be inserted into the guide cylinder (48) from the housing side, with centering being assured by projecting noses (120) and (122). The material nozzle itself has a carbide insert (124) that forms the actual nozzle and projects with a flat face (126) on the housing side beyond the holding element (125) holding the nozzle. This flat face (126) doubles as a valve seat for the valve head (127) on the front face of the valve body (102) or (30). An elastic element which then acts as the valve head (55) can then be placed in the front face of the valve body (30), (102), to compensate for any tilting. It is possible by appropriate design to achieve a simple construction and hence easy maintenance of the valve head, the valve plates (53) described in connection with FIG. 2 then being unnecessary. It is also not necessary for the valve head to be designed spherical, as shown in FIGS. 2 and 4. Instead, the surface facing the valve seat (126) can be designed flat, as indicated in FIG. 6.

FIG. 7 is an exploded view of the check valve (5) which can be designed as a replaceable unit in accordance with a further feature of the invention. The check valve (5) comprises a screw-in cage (174) in which is arranged a contact pressure spring (176) with carbide or ceramic sealing sphere (178), valve seat (180) and sealing disk (182). When the check valve (5) is worn, the previously mentioned unit comprising elements (174) to (182) only needs to be removed from the housing for replacement by a new one. The result is considerably easier maintenance.

FIGS. 5 and 6 show particularly noteworthy embodiments of high-pressure dosing guns (500) and (600) in accordance with the invention that operate with or without compressed air (airless method). In all other respects, the design of the high-pressure dosing guns (500) and (600) is identical, so that identical elements are numbered identically.

A cartridge (504) is arranged fixedly in a gun housing (502). A first cylindrical casing or bush (506) is screwed into the cartridge (504) and has a radial outward projection (508). The front end (510) of the casing (506), i.e. of the hollow-cylinder-type body, has an internally pointing radial section for holding a grooved-ring seal (512) between the first casing (506) and a hollow cylinder element (514). A so-called revolving valve body (518) comprising a cylinder section (520) with spherical valve sections (522) or (524) at the front faces is clamped detachably between the grooved-ring seal (512) and a section (516) extending radially inwards of the cartridge element (504). The section (520) can be designed hollow. Spacer elements project from the outside of the section (520) in the direction of the inside of the first casing (40), in order to ensure a fixed position of the revolving valve body (518) in the casing (506). These spacer elements are numbered (526) and (528) in FIG. 9. In the side view, the revolving valve body (518) is bone-shaped, with the front parts (530) and (532) being on the one hand in contact with the grooved-ring seal (512) and on the other hand with the section (516) of the cartridge element (504). It is clear that the cylindrical section (520) can be flowed around completely by the medium such as polishing paste to be issued by the high-pressure dosing gun (500) or (600). This medium is conveyed by a compressed air motor, not shown but already mentioned, from the housing (502) via the supply chamber (534) into the first working chamber (536) between the revolving valve body (518) and the inner face of the first casing (506).

The revolving valve body (518) is designed symmetrically both in its main axis (518) and in its secondary axis (540) running perpendicular thereto. The advantage thereby obtained is that when a valve head (522) or (524) is worn, the revolving valve body (518) only has to be turned in order to align the not yet worn valve head (524) or (522) respectively to the hollow cylinder (514) forming the valve seat (542) on the front. Here, the hollow cylinder (514) is also designed symmetrically in both its longitudinal axis (538) and its secondary axis, so that turning is possible.

The hollow cylinder (514) or valve seat can be of carbide, ceramics, boron carbide or similar.

The first working chamber (536) is sealed on the one hand between the valve seat (542) and the valve head (522) contacting it, and on the other hand by the grooved ring (512) supported on the outer face of the hollow cylinder (514).

The hollow cylinder (514) is now designed movable relative to the first casing (506), in order to be at a distance from or in contact with the valve head depending on the pressure prevailing in the first working chamber (536). To do so, a second casing or bush (544) is provided that surrounds the first casing (506) in some areas and is designed to be movable along this casing. The second casing (544), i.e. the hollow cylinder-shaped body, has a front section (546) that tapers outwards and in whose interior a seal (548), preferably of nylon, can be inserted that is connected with the hollow cylinder (514) in a press fit, for example. A nozzle (550) is in contact with the outside of the seal (548), through which the medium is sprayed. The nozzle (550) is held by a first cap nut (552) which can be screwed onto the section (546) of the second casing (544) in such a way that the seal (548) is clamped in the tapered extension of the internally conical section (546) of the second casing (544). As a result, the hollow cylinder (514) providing the valve seats (542) and (554) is fixed at the same time.

The second casing (544) has one or more leak holes (572) which prevent vacuum or gauge pressure building up between the first and second casings (506) and (544) in the area (574) of the hollow cylinder (514) as a result of the movement of the second casing relative to the first, which might impair mutual movability. In addition, medium coming out of the seal (548) and passing along the outer face into the area (574) can come out of the leak holes (572) so that medium cannot collect and thereby affect movability. At the same time it becomes clear when medium comes out that an inspection of the seal (512) and of the hollow cylinder (514) is necessary.

The second casing (544) can now be moved against the force of a spring (556) fixed between the second casing (544) and a second cap nut (558) extending from the cartridge element (504). The force of the spring (556) is directed such that the second casing (544) is forced in the direction of the housing (502). As a result, contact of the valve seat (542) with the valve head (522) of the revolving valve body (518) arranged fixedly in the cartridge element (504) and hence in the housing (502) is achieved.

The front part of the second cap nut (558) has a section (560) projecting radially inwards that serves as a stop for the second casing (544).

Movement of the second casing (544) and hence liftoff of the valve seat (542) from the valve head (522) takes place when the pressure prevailing in the first working chamber (536) overcomes the force exerted by the spring element (556). In this case, the medium can flow through a channel (562) extending into the nozzle (550) to be sprayed.

In order to turn round or replace the wear parts such as the revolving valve (518) and the hollow cylinder (514) containing the valve seats (542) and (554), it is only necessary to remove the second cap nut (558) after loosening the first cap nut (552), so that the second casing (544) and then the first casing (506) can be removed one after the other for subsequent changing or turning of the wear parts.

The embodiment according to FIG. 6 differs from that in FIG. 5 to the extent that lifting off of the second casing (544) and hence of the valve seat (542) from the valve body (518) is with the assistance of compressed air, with mixing of the spray medium and compressed air taking place simultaneously by outlet channels (562) running in the area of the nozzle (550).

A second working chamber (564) connected to a compressed air source not shown is provided for this purpose.

The second working chamber (564) is laterally limited on the one hand by the section (508) extending radially outwards of the first casing (506) and on the other hand by a section (566) parallel thereto and extending radially outwards of the second casing (546), whose opposite wall serves as a support for the spring element (556). The second working chamber (564) is further limited by a section of the inner wall of the cap nut (558) and by the outer face of the first casing (506) or an annular element not shown in detail.

If the working chamber (564) is acted upon by to compressed air, part of the spring force exerted by the spring element (556) is overcome. As a result, liftoff of the valve seat (542) from the valve head (522) is assisted. The compressed air then flows from the working chamber (564) through the area between the second casing (544) and the second cap nut (558) to the outlet channels (562).

I claim:

1. In a dosing gun for spraying a medium such as polishing paste comprising a housing, a cartridge element held in said housing, a valve body, a valve seat, a spring element, means defining a first working chamber between said valve seat and said valve body, said valve body and said valve seat being movable relative to one another against the force of said spring element if an adequate pressure is generated by said medium in said first working chamber between said valve seat and said valve body, and a nozzle;

the improvement comprising a first casing, said valve body being mounted detachably on said first casing, said first casing extending from one of said cartridge element and said housing, means defining a hollow cylinder movable relative to said first casing, said valve seat being formed in the frontal part of said hollow cylinder, and a second casing operatively connected to said means defining a hollow cylinder and movable against said spring element.

2. A dosing gun as set forth in claim 1 including a cap nut securing said nozzle to said dosing gun.

3. A dosing gun as set forth in claim 1 including means defining outlet channels for supplying air in the area around said nozzle, and means for supplying air under pressure to said outlet channels.

4. A dosing gun as set forth in claim 1 in which there is a space around the valve body through which said medium can flow, and said valve body is spaced from said first casing by spacer elements which extend integrally from said valve body.

5. A dosing gun as set forth in claim 4 in which the valve body and its spacer elements are symmetrical with regard to a primary axis extending through the center of said valve body, towards said nozzle and to a secondary axis, perpendicular thereto.

6. A dosing gun as set forth in claim 1 in which the hollow cylinder is symmetrical with regard to a primary axis extending through the center of said hollow cylinder and towards said nozzle, and to a secondary axis, perpendicular thereto.

7. A dosing gun as set forth in claim 1 including means defining outlet channels for supplying air in the area around said nozzle, means for supplying air under pressure to said outlet channels extending radially outwards from said first and second casings, means defining a second working chamber such that, when acted upon by compressed air, said second casing is movable against the force of the spring element, with a connection existing between said working chamber and said outlet channels.

8. A dosing gun as set forth in claim 1 in which said first working chamber is sealed.

9. A dosing gun as set forth in claim 8 in which said first working chamber is sealed by a grooved ring on the outside of the hollow cylinder.

10. A dosing gun as set forth in claim 1 including a seal, between the hollow cylinder and the nozzle and supported on the second casing, and a cap nut holding said nozzle, said nozzle being threadably connected to said second casing for fixing of said cap nut and said seal.

11. A dosing gun as set forth in claim 10 in which said seal in comprised of plastic.

12. A dosing gun as set forth in claim 1 including a second cap nut surrounding said casing in some areas and extending from the cartridge element or the housing, the spring element running between the outside of the second casing and said second cap nut.

13. A dosing gun as set forth in claim 12 in which the second cap nut has a stop limiting the movement of the second casing.

14. A dosing gun for spraying a medium such as polishing paste comprising a housing, a cartridge element held in said housing, a valve body in said housing, a spring element, said valve body being movable against the force of said spring element, a valve seat, said valve body being at a distance from or in contact with said valve seat, a nozzle and a first cap nut holding said nozzle, said nozzle having a contact collar in contact on the inside with said first cap nut;

the improvement in which said nozzle is held by said first cap nut so as to be rotatable and axially movable against the force of said spring element.

15. A high-pressure dosing gun as set forth in claim 14 including a perforated disk element containing said valve seat, said perforated disk element being in floating contact with said nozzle.

16. A high-pressure dosing gun as set forth in claim 15 including a further cap nut threadably connected to said cartridge element and fastening said first cap nut, said further cap nut having a front passage orifice which has, at least in some areas, a lower clear diameter than the perforated disk element.

17. A high-pressure dosing gun as set forth in claim 14 including a first wall and a second, movable wall, said spring element being supported, on the one hand, against said first wall and, on the other hand, against said second, movable wall, and said valve body being operatively connected to a valve piston, said second movable wall being movable into contact with the rear face of said valve piston.

18. A high-pressure dosing gun as set forth in claim 17 including a valve piston guide in which said valve body is movably mounted, said valve piston guide having a section with a shoulder used as a stop for the second wall.

19. A high-pressure dosing gun as set forth in claim 18 in which said section used as a stop is a replaceable wear bush.

20. A high-pressure dosing gun as set forth in claim 19 in which said valve body is a hollow element through which said medium flows, and including a continuous seal in the walls of said hollow element to seal against said wear bush.

21. In a dosing gun for spraying a medium such as a polishing paste comprising a housing, a cartridge element extending from the housing, a spring element, a valve body and an associated valve seat, means defining a first working chamber between said valve seat and said valve body, said valve body and said valve seat being movable relative to one another against the force of said spring element if an adequate pressure is generated by said medium in said first working chamber, and a nozzle, the improvement in which said dosing gun further comprises a hollow guide cylinder surrounding at least some areas of said valve body, said valve body and said hollow guide cylinder being movable relative to one another, a valve element which includes said valve seat, said valve element being positioned between said hollow guide cylinder and said nozzle, means defining a further working chamber, and means for supplying compressed air to said further working chamber to move said valve body relative to said valve element.

22. A dosing gun as set forth in claim 21 including a cap nut securing said nozzle to said dosing gun.

23. A dosing gun as set forth in claim 21 including means defining outlet channels for supplying air in the area around said nozzle, and means for supplying air under pressure to said outlet channels.

24. A dosing gun as set forth in claim 21 in which said valve body is a hollow needle having a radially curved outlet channel at its end section projecting into said first working chamber and said valve body comprising a valve head supported on the end of said hollow needle in said first working chamber.

25. A dosing gun as set forth in claim 21 in which said valve body includes an element extending radially outwards which is constructed and arranged so that, on one side, it faces and closes said further working chamber and, on the opposite side, it is acted upon by said spring element with a force directed away from the housing.

26. A dosing gun as set forth in claim 25 in which said radially-extending element is a piston.

27. A dosing gun as set forth in claim 25 in which said valve body surrounds a hollow cylinder in axially movable manner, said cylinder being connected to the housing or the cartridge element and providing a passageway for said medium to be sprayed by said dosing gun.

28. A dosing gun according to claim 21 in which the nozzle is supported by said hollow guide cylinder and has an insert of carbide to provide a valve outlet orifice on its outside and said valve set on its inside.

29. A dosing gun as set forth in claim 28 in which the valve seat is flat to make contact with a flat front face or a flat or if necessary elastic replaceable end piece of the valve body.

30. A dosing gun as set forth in claim 21 including a line carrying the medium and a check valve in said line, said valve comprising a replaceable unit including a screw-in cage, a contact spring therein, a valve ball, a valve seat and sealing disc.

31. A dosing gun as set forth in claim 21 in which the first working chamber contains said medium and said first working chamber is sealed by, on the one hand, said valve seat and, on the other hand, by a seal running between the valve body and the hollow guide cylinder.

* * * * *